US008763434B2

(12) United States Patent
David et al.

(10) Patent No.: US 8,763,434 B2
(45) Date of Patent: Jul. 1, 2014

(54) KEY WITH STOWABLE INSERT AND CORRESPONDING EXTENSION MODULE

(75) Inventors: Marc David, Creteil Cedex (FR); Benolt Delande, Creteil Cedex (FR)

(73) Assignee: Valeo Securite Habitacle, Creteil (FR)

( * ) Notice: Subject to any disclaimer, the term of this patent is extended or adjusted under 35 U.S.C. 154(b) by 116 days.

(21) Appl. No.: 13/060,743

(22) PCT Filed: Aug. 28, 2009

(86) PCT No.: PCT/EP2009/061170

§ 371 (c)(1),
(2), (4) Date: Jun. 20, 2011

(87) PCT Pub. No.: WO2010/023294

PCT Pub. Date: Mar. 4, 2010

(65) Prior Publication Data

US 2011/0259064 A1 Oct. 27, 2011

(30) Foreign Application Priority Data

Sep. 1, 2008 (FR) ..... 08 55835
Dec. 10, 2008 (FR) ..... 08 06917

(51) Int. Cl.
*A44B 15/00* (2006.01)

(52) U.S. Cl.
USPC ..... 70/456 R; 70/408; 70/459

(58) Field of Classification Search
USPC ..... 70/408, 456 R, 459
See application file for complete search history.

(56) References Cited

U.S. PATENT DOCUMENTS 2,822,684 A * 2/1958 Ray ..... 70/456 R
4,888,970 A * 12/1989 Kinzler et al. ..... 70/456 R (Continued)

FOREIGN PATENT DOCUMENTS

DE 10 2006 036503 A1 2/2008
EP 1 609 931 A1 12/2005
FR 2915759 A1 * 11/2008 ..... E05B 19/04

OTHER PUBLICATIONS

International Search Report w/translation from PCT/EP2009/061170 dated Oct. 22, 2009 (4 pages).

*Primary Examiner* — Suzanne Barrett
(74) *Attorney, Agent, or Firm* — Osha Liang LLP

(57) ABSTRACT

The invention relates to a key, in particular for an automobile, which comprises: —a casing (3) with an upper half shell (3*a*) defining a lid and a lower half shell (3*b*) defining a casing bottom; —an insert (5, 7) pivotally mounted relative to the casing (3) and capable of movement between a rest position in which the insert (5, 7) is stowed in said casing (3) and a use position in which the insert (5, 7) is extended relative to said casing (3); —an insert (5, 7) extension device mounted in the casing (3) and including: a push button (19) axially received in a cavity (21) combined with the upper half shell (3*a*) and protruding from the upper half shell (3*a*) so as to be actuated by a user; and an elastic return member (23) for the insert (5, 7), having a first end (23*a*) connected to the insert (5, 7) for pivotally urging the insert (5, 7) into the use position when the push button (19) is actuated. According to the invention, the push button (19) includes a means for the rotational blocking of the push button (19) relative to the casing that defines an axial-translation guide for the push button (19), and said return member (23) is attached to the push button (19) by a second end (23*b*). The invention further relates to an extension module for the insert (5, 7) of such a key.

15 Claims, 3 Drawing Sheets

(56) References Cited

U.S. PATENT DOCUMENTS

Figure 1A:
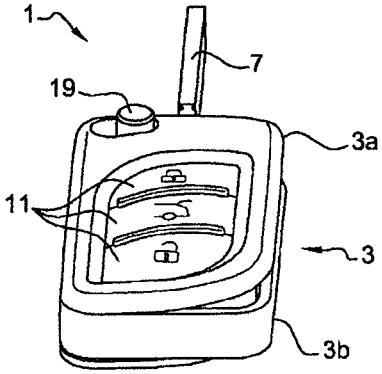

| | | | | |
|---|---|---|---|---|
| 5,943,889 | A * | 8/1999 | Chiu | 70/456 R |
| 6,499,326 | B1 * | 12/2002 | Heussner | 70/399 |
| 6,691,539 | B2 * | 2/2004 | Jacob et al. | 70/408 |
| 6,705,141 | B1 * | 3/2004 | Jacob et al. | 70/408 |
| 7,055,352 | B2 * | 6/2006 | Meyerson et al. | 70/456 R |
| 7,127,922 | B2 * | 10/2006 | Khounsombath et al. | 70/456 R |
| 7,370,501 | B2 * | 5/2008 | Miyata et al. | 70/395 |
| 8,225,633 | B2 * | 7/2012 | Luo et al. | 70/456 R |
| 8,266,936 | B2 * | 9/2012 | Box et al. | 70/408 |
| 2005/0103070 | A1 * | 5/2005 | Meyerson et al. | 70/456 R |
| 2005/0204789 | A1 * | 9/2005 | Brion Camean et al. | 70/456 R |
| 2007/0062229 | A1 * | 3/2007 | Miyata et al. | 70/408 |
| 2012/0285208 | A1 * | 11/2012 | Delande et al. | 70/399 |

* cited by examiner

KEY WITH STOWABLE INSERT AND CORRESPONDING EXTENSION MODULE

The invention relates to keys, notably for motor vehicles, the key head of which comprises a casing and of which the part comprising the key bit, which is known as the insert, can be retracted into and stowed inside the casing.

The invention also relates to a module for deploying or extending the insert of such a key.

Key structures that form a casing with a retractable mechanical insert have already been proposed, and in these the insert is mounted so that it can pivot between a rest position in which the insert is retracted and stowed inside a housing inside the casing, and a position of use in which the insert is deployed out of the casing.

Such an articulation of the insert requires an insert deployment mechanism that is mounted inside the casing. Known, for example, is a deployment mechanism mounted between the bottom of one half-shell of the casing and a retaining wall of this half-shell and which comprises:

- a clevis secured to the key bit and mounted so that it can pivot in the casing about an axis of pivoting between the rest position and the position of use,
- a push-button mounted in a housing of the clevis so as to be secured in terms of pivoting to the clevis, and
- a spring interposed between the bottom of the half-shell and the push-button so as elastically to return the clevis to the position of use.

However, this deployment mechanism employs a great many components which furthermore are relatively bulky and can have a tendency to monopolize a substantial volume within the casing.

Furthermore, such a mechanism does not make it possible to achieve a push-button for triggering the deployment mechanism which is prevented from rotating with respect to the casing, in order to meet certain manufacturer requirements.

It is an objective of the invention to provide an optimized key in which the number of parts is limited while at the same time making it possible to obtain a push-button which is blocked against rotation.

To this end, the subject of the invention is a key, notably for a motor vehicle, comprising:

- a casing with an upper half-shell forming a lid and a lower half-shell forming the casing bottom,
- an insert mounted so that it can pivot with respect to said casing between a rest position in which the insert is retracted or stowed in said casing and a position of use in which the insert is deployed out of said casing,
- a mechanism for deploying the insert which is mounted in said casing and comprises:
  - a push-button housed axially in an associated housing of the upper half-shell and projecting with respect to the upper half-shell to be actuated by a user, and
  - an elastic return element for returning the insert, a first end of which is connected to the insert to urge the insert to pivot towards said position of use when the push-button is actuated, characterized in that the push-button comprises a means for blocking the rotation of the push-button with respect to said casing that forms a guide for the push-button in axial translation, and in that said return element is fixed to the push-button by a second end.

Thus there is obtained a key that has a low number of parts and a push-button that is blocked against rotation by means of a single push-button which triggers the deployment mechanism and which acts as an element blocked against rotation for the return element that urges the insert and acts as an axis of pivoting for the insert.

Such a push-button may additionally have any overall shape because it is not called upon to rotate.

Said key may further comprise one or more of the following features, considered separately or in combination:

- the push-button and said guide-forming blocking means are produced as a single piece, and so no additional component is needed to guide translational movement and block rotational movement of the push-button;
- said guide-forming blocking means comprises at least one guide lug that guides the push-button and collaborates with a corresponding slot (27) of said housing of said upper half-shell;
- said guide-forming blocking means comprises three uniformly distributed guide lugs for guiding the push-button, and this provides a stable axis for translational guidance and optimizes the guidance of the push-button;
- the push-button has a hollow interior space in which the second end of said return element is housed;
- two first parallel lips are formed in the closed end of the push-button and accept the second end of said return element, so as to block the second end of said return element with respect to the push-button blocked against rotation;
- the insert comprises a key bit and a key bit support secured to the key bit mounted so that it can pivot with respect to said casing, and the first end of said return element is fixed to the key bit support so that said return element urges said support to pivot with respect to said casing in order to deploy the key, bit when the push-button is actuated;
- said support comprises a hollow pin inside which the first end of said return element is housed;
- two second parallel lips are formed in said pin and accept the first end of said return element, so as to block the first end of said return element with respect to said pin of said support that pivots with respect to said casing;
- said pin is connected to an internal side wall of said support by a radial bridge;
- said lower half-shell of said casing has a recess to accept said support in said rest position, and an orifice is provided on the internal wall of said lower half-shell in the region of the recess into which said pin can be nested;
- said key comprises a means of halting the translational movement of the push-button which means is formed in said support;
- said halting means comprises a stop post formed out of the lower half-shell and which enters a cavity provided in said support;
- the push-button comprises at least one retaining projection which holds the insert in the rest position, said support comprises an open flange through which said retaining projection can pass, and said flange has a notch collaborating with said retaining projection, so that said retaining projection engages said notch in the rest position and so that said retaining projection releases said notch when the push-button is actuated, so as to allow said support to pivot, such an open flange allows for simplified assembly of the push-button and of said support;
- said return element is produced in the form of a helical torsion spring.

The invention also relates to an insert deployment module for a key with retractable insert configured to be mounted in a casing of said key, comprising:

an insert with a key bit support and a key bit secured to said support, a push-button housed in an orifice of said support, and an elastic return element for returning the insert, characterized in that said return element is fixed, on the one hand, to said support and, on the other hand, to the push-button.

Such a deployment module is assembled independently of a casing of the key into which the insert is intended to be retracted for stowage and, once assembled, this deployment module forms an entity that can easily be handled and that can be fitted simply into said casing.

Furthermore, such a deployment module allows the return element easily to be preloaded at the time of assembly of this deployment module.

Figure 1B:
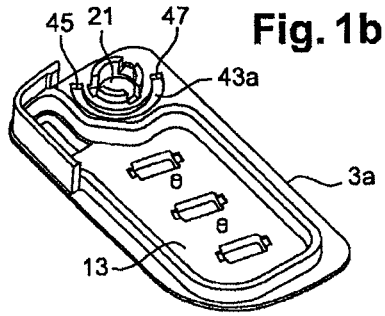
Figure 1C:
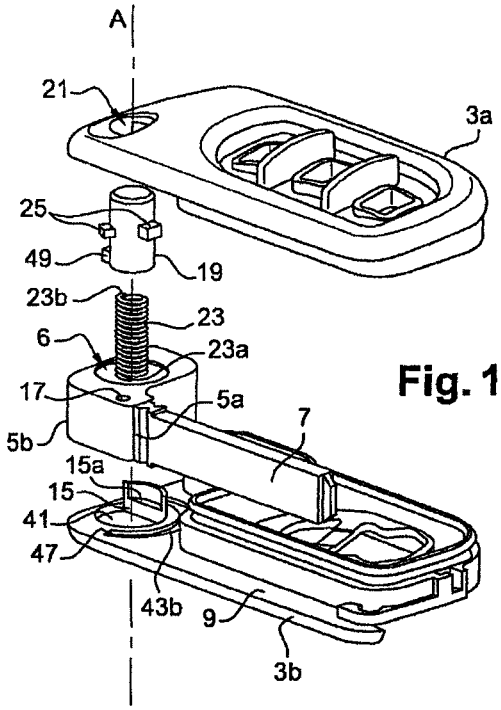
Figure 2:
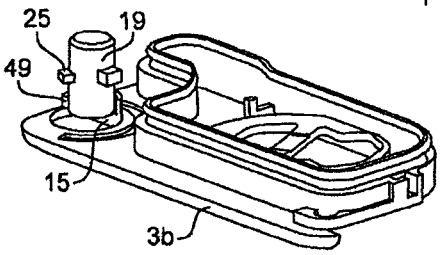
Figure 1D:
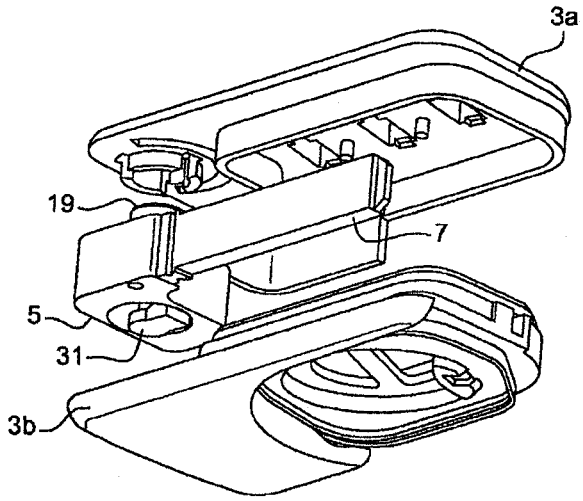
Figure 3A:
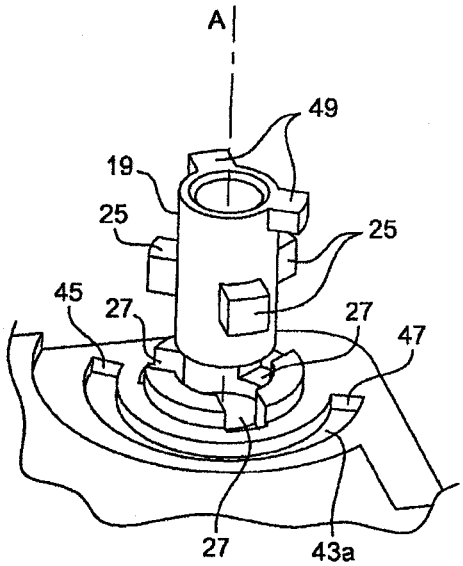
Figure 3B:
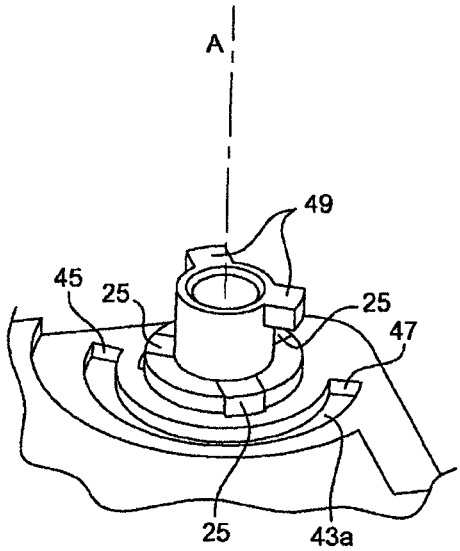
Figure 4A:
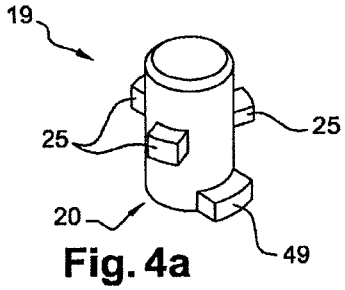
Figure 4B:
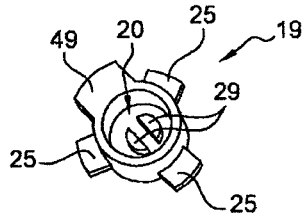
Figure 5A:
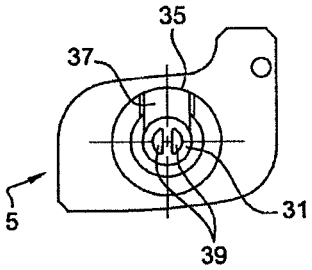
Figure 5B:
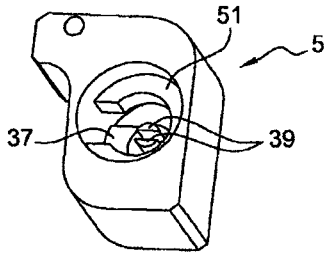
Figure 5E:
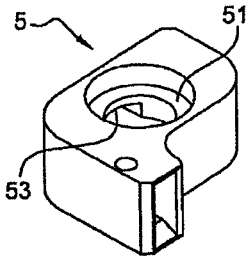
Figure 5D:
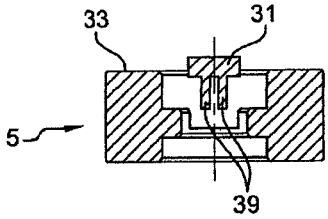
Figure 5C:
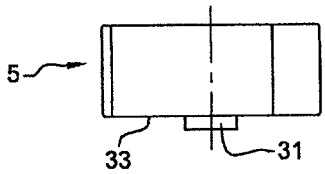

Other features and advantages of the invention will become more clearly apparent from reading the following description, given by way of illustrative and unlimiting example, and from studying the accompanying drawings among which:

FIG. 1*a* depicts a key according to the invention,

FIG. 1*b* depicts an upper half-shell of the casing of the key of FIG. 1*a*, FIG. 1*c* depicts an exploded view of the key of FIG. 1*a*, FIG. 1*d* is a perspective of FIG. 1*c* from below, FIG. 2 is a view in greater detail of the lower half-shell and of the push-button of the key of FIG. 1*a*, FIG. 3*a* depicts an exploded view with a push-button and of a push-button housing on the upper half-shell of the casing of the key of FIG. 1*a*, FIG. 3*b* is a view of the push-button mounted in the housing of FIG. 3*a*, FIG. 4*a* depicts a push-button for the key of FIG. 1*a*, FIG. 4*b* is a view of the push-button of FIG. 4*a* from beneath, FIG. 5*a* depicts a key bit support for the key of FIG. 1*a*, FIG. 5*b* is a view of the key bit support of FIG. 5*a*, from above, FIG. 5*c* is a side view of the key bit support of FIG. 5*a*, FIG. 5*d* is a cross section through the key bit support of FIG. 5*c*, and FIG. 5*e* is a partial side view of the key bit support of FIG. 5*a*.

The key 1 depicted in FIGS. 1*a* to 1*d* comprises:

a casing 3 forming the head of the key, an insert 5, 7 comprising a key bit support 5 and a key bit 7 secured to the support 5, and a mechanism for deploying the insert 5, 7 with respect to the casing 3 to allow the insert 5, 7 to move between:

a rest position (FIGS. 1*c*, 1*d*) in which the insert 5, 7 is retracted and stowed inside the casing 3 in a recess 9 provided inside the casing 3, for example in a substantially L-shape corresponding to the shape of the insert 5, 7, and a position of use (FIG. 1*a*) in which the insert 5, 7 has been deployed with respect to the casing 3 so that it can be introduced into a lock.

In the example illustrated, the casing 3 is produced in two parts in the form of an upper half-shell 3*a* that forms a lid and of a lower half-shell 3*b* that forms a bottom of the casing, it being possible for these two half-shells 3*a*, 3*b* to be assembled, for example by clipping them together. A gasket (not depicted) may be positioned between the two half-shells 3*a*, 3*b* to protect the inside of the casing 3 against the external environment, particularly against moisture or dust. A decorative surround (not depicted), positioned between the two half-shells 3*a*, 3*b* to make the assembly more attractive may also be provided.

The key 1 may also combine a mechanical key with an electronic key. In that case, a printed circuit board (not depicted) is positioned inside the casing 3. This board carries the electronic remote control circuits for the central locking/unlocking of the opening panels of the vehicle, together with a transponder (not depicted) for the vehicle anti-theft system and a battery (not depicted) to power the remote control function. This remote control function is actuated by the operator through actuating buttons 11 provided on the upper half-shell 3*a*. A cover 13 may be positioned inside the casing 3 to conceal the electrical or electronic components of the remote control casing 3.

Furthermore, the support 5 has two opposite ends 5*a*, 5*b*, of which the end 5*a* bears the key bit 7. To do so, one end 7*a* of the key bit 7 may be pushed into a complementary housing (not depicted) at the end 5*a* of the support 5. The support 5/key bit 7 assembly is held together for example by a peg (not depicted) passing through holes 17 made in the support 5 and in the key bit 7. Of course, the key bit 7 may be fixed to the support 5 by any other appropriate means.

Furthermore, the mechanism for deploying the insert 5, 7 comprises:

a push-button 19 housed in an associated housing 21 of the upper half-shell 3*a* and passing through an orifice 6 in the support 5, the push-button 19 projecting with respect to the upper half-shell 3*a* so as to be accessible to a user so that he can actuate this push-button 19 in order to deploy the insert 5, 7, and an elastic return element 23 fixed by a first end 23*a* to the insert 5, 7 and by a second end 23*b* to an element blocked against rotation with respect to the casing 3, to urge the insert 5, 7 to pivot toward the position of use when the push-button 19 is actuated. This return element 23 is, for example, a helical torsion spring.

When the push-button 19 is actuated via the user, the push-button 19 is driven in an axial translational movement along the longitudinal axis A within the support 5.

In order to prevent the push-button 19 from coming into abutment against the end wall of the support 5 at the end of travel, a means of halting the push-button 19 may be provided. This stop means may comprise a stop post formed in the support 5 and with which the push-button 19 comes into contact at the end of its travel, so that the translational movement of the push-button 19 is halted before this push-button reaches the end wall of the support 5.

In the embodiment illustrated in FIGS. 1*c*, 1*d* and 2, the support 5 has, in its closed end, a cavity (FIG. 1*d*), for example in the shape of an arc of a circle extending over more than 180°, and the stop means comprises a stop post 15 (FIGS. 1*c* and 2) extending from the lower half-shell 3*b* and entering the support 5 at this arc of a circle. This stop post 15 additionally has a recess defining a surface 15*a* for contact with the push-button 19 at the end of travel. Further, the push-button 19 comprises a means of blocking the rotation of the push-button with respect to the casing 3. This blocking means forms a guide for the push-button 19 guiding its axial translation along the longitudinal axis A of the push-button 19 and is produced as one piece with the push-button 19.

Thus, it is the push-button 19 which is used to trigger the deployment mechanism and to guide the translational movement of the push-button 19 and to block the push-button 19 against rotating.

In the example illustrated, this guide-forming blocking means comprises at least one guide lug 25 which extends projecting outwards from the outer surface of the push-button 19. Provision may be made for the push-button 19 to comprise two diametrically opposite guide lugs 25 or, alternatively, three evenly distributed guide lugs 25 for optimized translational guidance.

With reference to FIGS. 3*a* and 3*b*, each guide lug 25 collaborates with a corresponding slot 27 provided at the housing 21 on the upper half-shell 3*a* for guiding the translational movement of the push-button 19 with respect to the casing 3 along the axis A and for immobilizing the push-button 19 in terms of rotation with respect to the casing 3.

Thus, bearing in mind the height of the guide lugs 25 or first tenons and of the increase in thickness opposite belonging to the upper shell, these tenons remain engaged in the slots 27 or first cavities and the button therefore remains blocked against rotation by connection with the upper shell.

The return element 23 for its part is fixed by its second end 23*b* to the push-button 19 which is thus stable in terms of rotation (FIG. 1*c*) without the need for any intermediate component between the push-button 19 and the return element 23 of the deployment mechanism.

Accordingly, as may be seen from FIGS. 4*a* and 4*b*, the push-button 19 has a hollow interior space 20 to house the second end 23*b* of the return element 23.

More specifically, two first parallel lips 29 are formed in the closed end of the push-button 19 and extend toward the second end 23*b* of the return element to accept this second end 23*b*. In this case, the second end 23*b* extends as a return inside the return element 23. The first lips 29 thus block the second end 23*b* with respect to the push-button 19 and therefore block the second end 23*b* against rotation with respect to the upper half-shell 3*a* of the casing 3.

Further, in order to urge the insert 5, 7 to pivot, the return element 23 is preferably fixed to the support 5 by its first end 23*a*.

Thus, the spring has its lower end blocked against rotation on the clevis or support of the insert, which is inserted in a groove arranged in the end wall thereof, and its upper end blocked against rotation in the closed end of the button, on the closed wall thereof. In said rest position, it is thus torsionally preloaded.

To achieve this, as may be seen from FIGS. 5*a*, 5*b*, the support 5 may comprise a hollow pin 31 to house the first end 23*a* of the return element 23 at the end wall of the support 5. This pin 31 is, for example, connected to an internal side wall 35 of the support 5 by a radial bridge 37 and may be formed as an integral part thereof.

In addition, second parallel lips 39 formed inside the pin 31 and which extend toward the first end 23*a* of the return element 23 may be provided for accepting this first end 23*a*. The first end 23*a* also extends as a return inside the return element 23. Thus, the second lips 39 block the first end 23*a* with respect to the pin 31 of the support 5 mounted so that it can pivot with respect to the casing 3 so as to allow the return force of the return element 23 to be transmitted to the support 5.

Furthermore, as illustrated by FIGS. 5*c*, 5*d*, the pin emerges with respect to the end wall 33 of the support 5. An orifice 41 (FIG. 1*c*) is therefore provided on the internal wall of the lower half-shell 3*b* at the recess 9 into which the pin 31 can be pushed when the support 5 is mounted in the casing 3.

As described earlier (refer to FIGS. 1*c*, 1*d*), the support 5 is open at its bottom in the arc of a circle into which opening the post 15 is inserted as the support 5 is mounted on the lower half-shell 3*b*. This arc of a circle is centered on the axis of pivoting A so that as the support 5 pivots, the stop post 15 travels along this arc of a circle until the radial bridge 37 comes into abutment against this stop post 15, so as to block the pivoting movement of the support 5.

In addition, to guide the pivoting of the support 5, the support 5 may further comprise two guide fingers (not depicted) one on each side of the second end 5*b* and which, under the effect of actuation of the push-button 19, are guided respectively by a first guide groove 43*a* formed in the upper half-shell 3*a* and by a second guide groove 43*b* formed in the lower half-shell 3*b* (see FIGS. 1*b* and 1*c*). These guide grooves 43*a*, 43*b* have a semicircular overall shape and are each delimited by two end stops 45, 47. Thus, when the guide fingers are resting against the end stops 45 the insert 5, 7 is in the rest position, and when the guide fingers are resting against the end stops 47, the insert 5, 7 is in the position of use.

Of course, any other means for guiding the pivoting of the support 5 may be used.

Moreover, the push-button 19 and the support 5, respectively fixed to the return element 23, work together to keep the insert 5, 7 in the rest position.

To do so, and with reference to FIGS. 4*a*, 4*b* and 5*b*, 5*e*, the push-button 19 comprises at least one retaining projection 49 for holding the insert 5, 7 in the rest position, and the support 5 comprises a flange 51. This flange 51 is open to allow the passage of the retaining projection 49 and has a notch 53 collaborating with the retaining projection 49 so that the retaining projection 49 engages the notch 53 in the rest position and releases the notch 53 when the push-button 19 is actuated, so as to allow the support 5 to pivot.

The assembly comprising the support 5, the key bit 7, the push-button 19 and the return element 23 forms a module for deploying the insert 5, 7. This deployment module is assembled independently of the casing 3.

Assembly of this deployment module involves the following steps (see FIGS. 1*c*, 4*a*, 4*b* and 5*a*):

- the end 7*a* of the key bit 7 is fixed to the end 5*a* of the support 5,
- the return element 23 is introduced through the orifice 6 in the support 5,
- the first end 23*a* of the return element 23 is fixed into the second lips 39 of the hollow pin 31 of the support 5,
- the push-button 19 is introduced through the orifice 6 and the push-button 19 is positioned in such a way that the retaining projection 49 of the push-button 19 lies above the opening of the flange 51 of the support 5,
- the second end 23*b* of the return element 23 is fixed in the first lips 29 in the interior space 20 of the push-button 19, and
- the retaining projection 49 is introduced into the opening in the collar 51 of the support 5 and the push-button 19 is turned to a predetermined angle so that the retaining projection 49 engages the notch 53 of the flange 51 of the support 5. The predefined angle is, for example, 90° for a quarter-turn fitting or 180° for a half-turn fitting.

Furthermore, when the return element 23 is a helical torsion spring, turning the push-button 19 until the retaining projection 49 engages the notch 53 provides a simple way of torsionally preloading the spring.

Of course, the order in which certain steps in the assembly of this deployment module are performed can be altered.

Once the deployment module has thus been assembled, it can be mounted in the casing 3. To do that, the support 5 is mounted on the lower half-shell 3*b* and the upper half-shell 3*a* is fitted in such a way that the push-button 19 is housed in the housing 21 of the upper half-shell 3*a* causing it to project with respect to the casing 3. The two half-shells 3*a*, 3*b* are then joined together.

The assembly comprising the support or clevis of the insert, the button and the spring is thus preassembled, with the spring preloaded. This arrangement therefore allows such a module to be prefabricated and delivered by a supplier to the manufacturer of the remote control device.

Thus, when an operator wishes to use the insert 5, 7 and therefore to deploy it out of the casing 3, he presses the push-button 19 the actuation of which releases the notch 53 of the support 5, thus allowing the return element 23 to relax.

Under the action of the return element 23, the support pivots with respect to the casing 3, the guide fingers of the support 5 being guided in the guide grooves 43*a*, 43*b* provided on the casing 3.

Under the effect of the pivoting of the support 5, the key bit 7 is disengaged from the recess 9 and then passes from its position in which it is retracted or stowed inside the casing 3, into its position in which it is deployed or extended with respect to the casing 3, in which position the key bit 7 can be used, creating for example an angle of 180°.

This position of use is attained when the guide fingers of the support 5 come against the end stops 43 of the casing 3, something which blocks any additional movement.

It will therefore be understood that such a deployment module forms a preassembled entity for the key 1 which allows the return element 23 to be stressed in an easy way at the time of assembly and which can be mounted simply in the casing 3 of the key 1, at the same time limiting the number of parts needed for articulating the insert 5, 7 in relation to the casing 3.

The invention claimed is:

1. A key for a motor vehicle, comprising:

a casing with an upper half shell forming a lid and a lower half shell forming the casing bottom;

an insert mounted to pivot with respect to said casing between a rest position in which the insert is retracted or stowed in said casing and a position of use in which the insert is deployed out of said casing;

a mechanism for deploying the insert which is mounted in said casing, wherein the mechanism comprises:

a push button housed axially in an associated housing of the upper half shell and projecting with respect to the upper half shell to be actuated by a user, and an elastic return element for returning the insert, a first end of which is connected to the insert to urge the insert to pivot toward said position of use when the push button is actuated, wherein the push button comprises a means for blocking the rotation of the push button with respect to said casing that forms a guide for the push button in axial translation, and wherein said elastic return element is fixed to the push button by a second end, wherein said guide forming blocking means comprises at least one guide lug that guides the push button and collaborates with a corresponding slot of said housing of said upper half shell, wherein said guide forming blocking means enables said push button to be non-rotatable with respect to said housing.

2. The key as claimed in claim 1, wherein the push button and said guide forming blocking means are produced as a single piece.

3. The key as claimed in claim 1, wherein said guide forming blocking means comprises three uniformly distributed guide lugs for guiding the push button.

4. The key as claimed in claim 1, wherein the push button has a hollow interior space in which the second end of said elastic return element is housed.

5. The key as claimed in claim 4, wherein two first parallel lips are formed in the closed end of the push button and accept the second end of said elastic return element.

6. The key as claimed in claim 1, wherein the insert comprises a key bit and a key bit support secured to the key bit mounted so that the key bit support pivots with respect to said casing, and wherein the first end of said elastic return element is fixed to the key bit support so that said elastic return element urges said support to pivot with respect to said casing in order to deploy the key bit when the push button is actuated.

7. The key as claimed in claim 6, wherein said key bit support comprises a hollow pin inside which the first end of said elastic return element is housed.

8. The key as claimed in claim 7, wherein two second parallel lips are formed in said hollow pin and accept the first end of said elastic return element.

9. The key as claimed in claim 8, wherein said hollow pin is connected to an internal side wall of said key bit support by a radial bridge.

10. The key as claimed in claim 7, wherein said lower half shell of said casing has a recess to accept said key bit support in said rest position, and wherein an orifice is provided on the internal wall of said lower half shell in the region of the recess into which said hollow pin is nested.

11. The key as claimed in claim 6, further comprising a means of halting the translational movement of the push button which is situated at least partially in said key bit support.

12. A key for a motor vehicle, comprising:

a casing with an upper half shell forming a lid and a lower half shell forming the casing bottom;

an insert mounted to pivot with respect to said casing between a rest position in which the insert is retracted or stowed in said casing and a position of use in which the insert is deployed out of said casing;

a mechanism for deploying the insert which is mounted in said casing, wherein the mechanism comprises:

push button housed axially in an associated housing of the upper half shell and projecting with respect to the upper half shell to be actuated by a user, and an elastic return element for returning the insert, a first end of which is connected to the insert to urge the insert to pivot toward said position of use when the push button is actuated;

wherein the push button comprises a means for blocking the rotation of the push button with respect to said casing that forms a guide for the push button in axial translation, and wherein said elastic return element is fixed to the push button by a second end;

wherein said guide forming blocking means comprises at least one guide lug that guides the push button and collaborates with a corresponding slot of said housing of said upper half shell;

wherein the insert comprises a key bit and a key bit support secured to the key bit mounted so that the key bit support pivots with respect to said casing;

wherein the first end of said elastic return element is fixed to the key bit support so that said elastic return element urges said support to pivot with respect to said casing in order to deploy the key bit when the push button is actuated;

further comprising a means of halting the translational movement of the push button which is situated at least partially in said key bit support;

wherein said halting means comprises a stop post formed out of the lower half shell and which enters a cavity provided in said key bit support.

13. The key as claimed in claim 6, wherein:

the push button comprises at least one retaining projection which holds the insert in the rest position, said key bit support comprises an open flange through which said retaining projection can pass, and said flange has a notch collaborating with said retaining projection so that said retaining projection engages said notch in the rest position and so that said retaining projection releases said notch when the push button is actuated, so as to allow said key bit support to pivot.

14. The key as claimed in claim 1, wherein said elastic return element is produced in the form of a helical torsion spring.

15. An insert deployment module for a key with retractable insert configured to be mounted in a casing of said key, comprising:

an insert with a key bit support and a key bit secured to said support;

a push button housed in an orifice of said key bit support, wherein the push button comprises a means for blocking the rotation of the push button with respect to said casing that forms a guide for the push button in axial translation, and wherein said elastic return element is fixed to the push button by a second end, and wherein said guide forming blocking means comprises at least one guide lug that guides the push button and collaborates with a corresponding slot of said casing; and an elastic return element for returning the insert, wherein said return element is fixed, on the one hand, to said key bit support and, on the other hand, to the push button, wherein said guide forming blocking means enables said push button to be non-rotatable with respect to said casing.

* * * * *